US005748060A

United States Patent [19]

Särkkä

[11] Patent Number: 5,748,060

[45] Date of Patent: May 5, 1998

[54] DIELECTRIC RESONATOR HAVING TWO PLANAR SURFACES WITH RESPECTIVE ADJUSTMENT PLATES PARALLEL THERETO

[75] Inventor: Veli-Matti Särkkä, Oulunsalo, Finland

[73] Assignee: Nokia Telecommunications Oy, Espoo, Finland

[21] Appl. No.: 640,799

[22] PCT Filed: Oct. 4, 1995

[86] PCT No.: PCT/FI95/00546

§ 371 Date: Jun. 4, 1996

§ 102(e) Date: Jun. 4, 1996

[87] PCT Pub. No.: WO96/11510

PCT Pub. Date: Apr. 18, 1996

[30] Foreign Application Priority Data

Oct. 5, 1994 [FI] Finland ..... 944662

[51] Int. Cl.[6] ..... H01P 7/10

[52] U.S. Cl. ..... 333/235; 333/219.1

[58] Field of Search ..... 333/219.1, 223–226, 333/231–233, 235

[56] References Cited

U.S. PATENT DOCUMENTS 4,477,788 10/1984 Collinet et al. ..... 333/202 X
4,849,722 7/1989 Cruchon et al. ..... 333/205

FOREIGN PATENT DOCUMENTS 0056502 4/1983 Japan ..... 333/219.1
5335818 12/1993 Japan ..... 333/233
6061713 3/1994 Japan ..... 333/219.1

OTHER PUBLICATIONS

Derwent's abstract, No. 94–158338/19, Week 9419, Abstract of SU, 1800523 (BUBNOV P M), 31 Mar. 1989.

*Primary Examiner*—Robert Pascal
*Assistant Examiner*—Barbara Summons
*Attorney, Agent, or Firm*—Cushman Darby & Cushman Intellectual Property Group of Pillsbury Madison & Sutro LLP

[57] ABSTRACT

A dielectric resonator including a resonator disc, and a frequency controller, composed of an electrically conductive adjustment plate, and a dielectric adjustment body, which are movable by means of an adjustment mechanism with respect to a planar surface or planar surfaces of the resonator disc. In one embodiment a conductive adjustment plate and a dielectric adjustment plate are situated on opposite sides of the resonator disc. In another embodiment, one or more dielectric adjustment bodies are attached to an electrically conductive adjustment plate to form a hybrid structure. In both embodiments, the conductive adjustment plate and the dielectric adjustment plate or adjustment body are dimensioned and selected so that they have frequency adjustment curves which are substantially similar, but opposite with regard to their slopes of adjustment, so that the combined curve of frequency adjustment of the frequency controller is substantially linear.

2 Claims, 4 Drawing Sheets

DIELECTRIC RESONATOR HAVING TWO PLANAR SURFACES WITH RESPECTIVE ADJUSTMENT PLATES PARALLEL THERETO

This application claims benefit of international application PCT/F195/00546, filed Oct. 4, 1995.

BACKGROUND OF THE INVENTION

The invention relates to a dielectric resonator comprising a dielectric resonator disc having two plane surfaces, and a frequency controller comprising an adjustment mechanism and an electrically conductive adjustment plane, which is substantially parallel with one of the planar surfaces of the dielectric resonator disc and movable by means of the adjustment mechanism in the perpendicular direction with respect to the resonator disc for adjusting the resonance frequency by changing the distance between the adjustment plane and that same one of the planar surfaces of the dielectric resonator disc, and an electrically conductive casing.

Recently, so-called dielectric resonators have become more and more interesting in high frequency and microwave range structures, as they provide the following advantages over conventional resonator structures: smaller circuit sizes, higher degree of integration, improved performance and lower manufacturing costs. Any object which has a simple geometric shape, and the material of which exhibits low dielectric losses and a high relative dielectric constant may function as a dielectric resonator having a high Q value. For reasons related to manufacturing technique, a dielectric resonator is usually of a cylindrical shape, such as a cylindrical disc.

The structure and operation of dielectric resonators are disclosed e.g. in the following articles:

[1] "Ceramic Resonators for Highly Stabile Oscillators", Gundolf Kuchler, Siemens Components XXIV (1989) No. 5, p. 180–183.

[2] "Microwave Dielectric Resonators", S. Jerry Fiedziuszko, Microwave Journal, September 1986, p. 189–189.

[3] "Cylindrical Dielectric Resonators and Their Applications in TEM Line Microwave Circuits", Marian W. Pospieszalski, IEEE Transactions on Microwave Theory and Techniques, VOL. MTT-27, NO. 3, March 1979, p. 233–238.

The resonance frequency of a dielectric resonator is primarily determined by the dimensions of the resonator body. Another factor that has an effect on the resonance frequency is the environment of the resonator. By bringing a metallic or any other conductive surface to the vicinity of the resonator, it is possible to intentionally affect the electric or magnetic field of the resonator, and thus the resonance frequency. In a typical method for adjusting the resonance frequency of the resonator, the distance of a conductive metallic surface from the planar surface of the resonator is adjusted. One prior art dielectric filter design of this kind is shown in FIG. 1, in which a resonator comprises inductive coupling loops 5 (input and output), a dielectric resonator disc 3 installed in a metal casing 4, supported by a dielectric leg 6, and a frequency adjuster attached to the metal casing 4, comprising an adjustment screw 1 and a metal plane 2. The resonance frequency of the resonator depends on the distance L between the resonator disc 3 and the metal plane 2 in accordance with a graph in FIG. 2.

Alternatively, it is also possible to introduce another dielectric body to the vicinity of the resonator body instead of a conductive adjustment body. One prior art filter design of this kind, based on dielectric plate adjustment is shown in FIG. 3, in which a resonator comprises inductive coupling loops 35 (input and output), a dielectric resonator disc 33 installed in a metal casing 34, supported by a dielectric leg 36, and a frequency adjuster attached to the metal casing 34, comprising an adjustment screw 31 and a metal plane 32. The resonance frequency of the resonator depends on the adjustment distance L between the resonator disc 33 and the metal plane 32 in accordance with a graph in FIG. 4.

As appears from FIGS. 2 and 4, in both adjustment techniques, the resonance frequency varies as a non-linear function of the adjusting distance. Due to this non-linearity and the steep adjustment slope, accurate adjustment of the resonance frequency is difficult and demands great precision, particularly at the extreme ends of the control range. Frequency adjustment is based on a highly accurate mechanical movement, the adjustment slope k also being steep. In principle, the length and thus the accuracy of the adjusting movement may be increased in both resonator types by reducing the size of the metallic or the dielectric adjustment plane. Due to the non-linearity of the above-mentioned adjusting techniques, however, the achieved advantage is small, since the portion of the adjusting curve which is too steep or too flat either at the beginning or at the end of the adjusting movement can not be used. When the resonance frequency becomes higher, e.g. to the range 1500–2000 MHz or higher, the dimensions of the basic elements of the dielectric filter, such as those of the resonator body or the adjustment mechanism are reduced even more. As a result, adjusting the resonance frequency of a dielectric resonator with prior art solutions sets very high demands on the frequency adjustment mechanism, which, in turn, increases the material and production costs. In addition, as the mechanical movements of the frequency adjustment device must be made very small, adjustment will be slower.

SUMMARY OF THE INVENTION

The object of the invention is a dielectric resonator providing a higher accuracy and linearity of frequency control.

This is achieved with a dielectric resonator, which is characterized in accordance with the invention by the frequency controller further comprising a dielectric adjustment plane, which is substantially parallel with the other one of the planar surfaces of the dielectric resonator disc and connected to the same adjustment mechanism as the conductive adjustment plane, so that the dielectric adjustment plane is movable in the perpendicular direction with respect to that other one of the planar surfaces for changing the distance between the dielectric adjustment plane and that other one of the planar surfaces of the dielectric resonator disc simultaneously and to the same extent, but in the opposite direction with respect to the distance between the conductive adjustment plane and the one planar surface, the conductive adjustment plane and the dielectric adjustment plane having frequency adjustment curves, which are substantially similar, but opposite with regard to the slope of adjustment, so that the combined slope of frequency adjustment of the frequency controller is substantially linear.

The invention further relates to a dielectric resonator which, in accordance with the invention is characterized in that the frequency controller further comprises at least one dielectric adjustment body, which is joined into a hybrid structure with the conductive adjustment plane, and connected to the same adjustment mechanism, so that the hybrid structure may be moved entirely in the perpendicular direction with respect to the planar surface of the dielectric resonator disc, for changing the distance between the hybrid structure and the planar surface, the conductive adjustment plane and the at least one dielectric adjustment body have frequency adjustment curves which are substantially similar, but opposite with regard to the slope of adjustment, so that the combined slope of frequency adjustment of the frequency controller is substantially linear.

In the invention, a resonance frequency adjustment based on the dielectric adjustment plane, and a resonance frequency adjustment based on the conductive adjustment plane, and having non-linear adjustment curves with opposite slopes of adjustment, are combined so that they either form a double adjuster structure or a hybrid adjuster structure having a linear adjustment curve. The advantages of the invention are improved linearity and a longer adjusting distance, which both improve the adjusting accuracy.

BRIEF DESCRIPTION OF THE DRAWINGS

In the following, the invention will be disclosed in greater detail by way of example with reference to the attached drawings, in which.

DETAILED DESCRIPTION

The structure, the operation and the ceramic manufacturing materials of dielectric resonators are disclosed e.g. in the above-mentioned articles [1], [2], and [3], which are incorporated herein by reference. In the following description, only the parts in the structure of the dielectric resonator which are essential to the invention will be described.

The term dielectric resonator body, as used herein, generally refers to any object which has a suitable geometric shape, and the manufacturing material of which exhibits low dielectric losses and a high relative dielectric constant. For reasons related to manufacturing technique, a dielectric resonator is usually of a cylindrical shape, such as a cylindrical disc. The most commonly used material is ceramic material.

The electromagnetic fields of a dielectric resonator extend beyond the resonator body, so it may easily be coupled electromagnetically to the rest of the resonator circuit in a variety of ways depending on the application, e.g. by means of a microstrip conductor placed in the vicinity of the resonator, an inductive coupling loop, a straight wire, etc.

The resonator frequency of a dielectric resonator is primarily determined by the dimensions of the dielectric resonator body. Another factor that has an effect on the resonance frequency is the environment of the resonator. By bringing a metallic or any other conductive surface, or alternatively another dielectric body, i.e. a so-called adjustment body, to the vicinity of the resonator, it is possible to intentionally affect the electric or magnetic field of the resonator, and thus the resonance frequency.

In the invention, resonance frequency adjustment measures based on the dielectric adjustment plane and the conductive adjustment plane having adjustment curves which are non-linear but opposite as to their slopes of adjustment are combined either to form a double adjuster structure (embodiment shown in FIG. 5) or a combination adjuster structure (embodiment shown in FIG. 7) having a more linear adjustment curve. The advantages of the invention are improved linearity and a longer adjusting distance, which both improve the adjusting accuracy.

Figure 1:
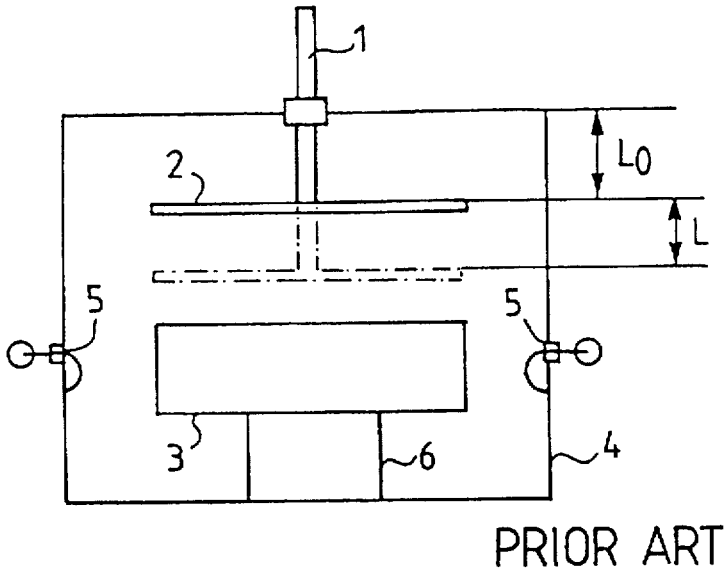
FIG. 1 shows a cross-sectional side view of a prior art dielectric resonator.
Figure 2:
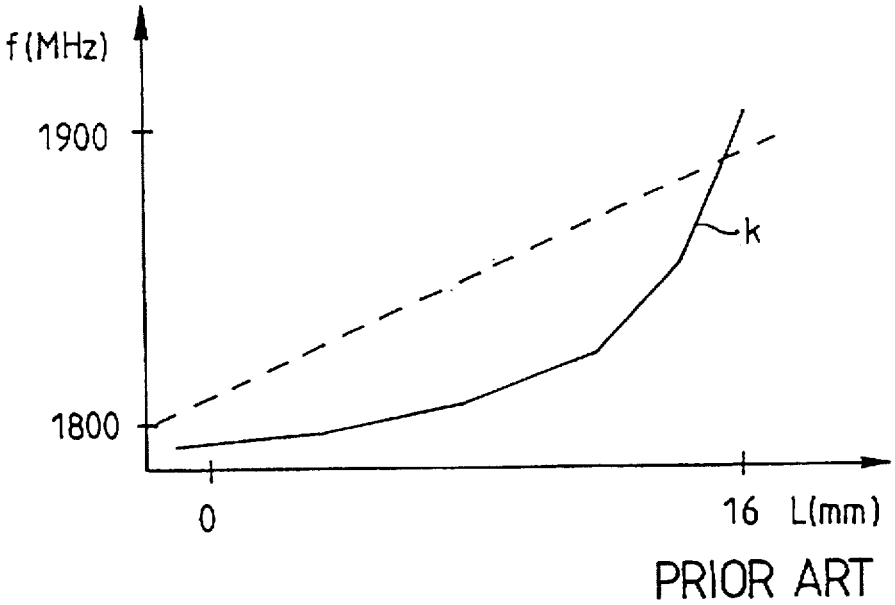
FIG. 2 shows a graph illustrating the resonance frequency of the resonator shown in FIG. 1 as a function of distance L.
Figure 3:
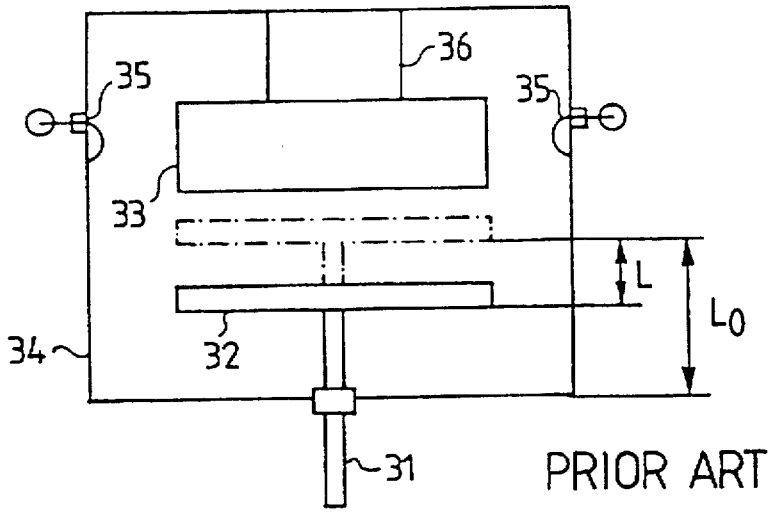
FIG. 3 shows a cross-sectional side view of other prior art dielectric resonator.
Figure 4:
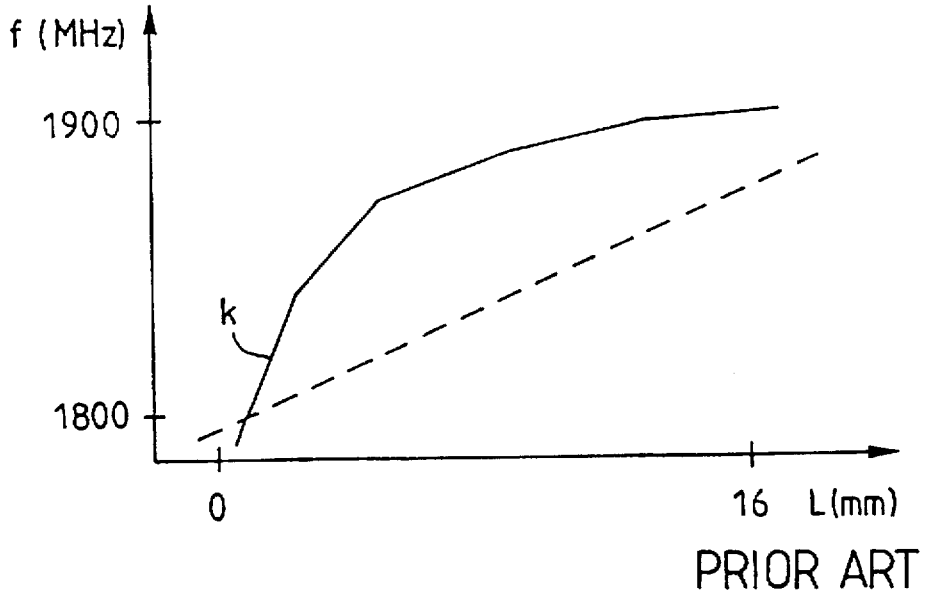
FIG. 4 shows a graph illustrating the resonance frequency of the resonator shown in FIG. 3 as a function of distance L.
Figure 5:
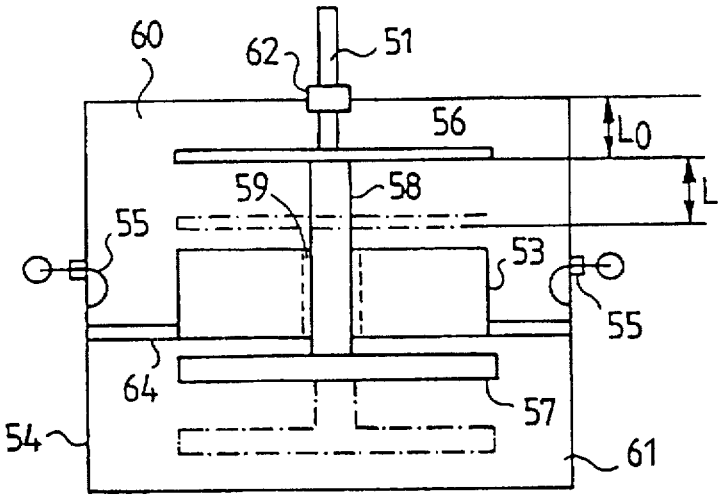
FIG. 5 shows a cross-sectional side view of a dielectric resonator of the invention.

FIG. 5 shows a dielectric resonator provided with a double adjuster structure according to the invention. The resonator comprises a dielectric, preferably a cylindrical or a disc-shaped resonator body 53 inside a casing 54 made of an electrically conductive material, such as metal, this body being supported by its perimeter surface by means of an isolating support or supports 64 vertically in the middle of the casing 54. The casing 54 is coupled to the ground potential. FIG. 5 shows by way of an example the coupling to the resonator by inductive coupling loops 55, which provide the input and the output of the resonator.

The double adjuster structure comprises a conductive adjustment plane, which is composed of a metal plane (or plate) 56, and a dielectric adjustment plane, which is composed of a ceramic plane (or plate) 57. The metal plane 56 is situated in casing 54 in a space 60 above the resonator disc 53 parallel with the top planar surface of the resonator disc. The ceramic adjustment plane 57 is situated in casing 54 in a space 61 below the resonator disc 53 parallel with the bottom planar surface of the resonator disc 53. The adjustment mechanism moving the adjustment planes 56 and 57 comprises an adjustment screw 51, which is attached by threads to an isolating bushing 62 in the lid of casing 54. The lower end of the adjusting screw 51 forms a pin 58, which extends through an axial centre hole 59 of the resonator disc 53 to the space 61 below the resonator disc 53. The metal adjustment plane 56 is attached to the adjustment screw 51 at the upper end of pin 58, and the ceramic adjustment plane 57 is attached to the adjustment screw 51 at the lower end of pin 58. The movement of the adjustment screw 51 moves the dielectric adjustment plane 57 with respect to the bottom planar surface, and the metal adjustment plane 56 with respect to the top planar surface of the resonator disc 53, by changing their distances from the respective planar surfaces of the resonator disc 53 simultaneously and to the same extent, but in the opposite directions. When the metal adjustment plane is at the end of the adjustment range L which is located most remote from the resonator disc 53, the ceramic adjustment plane 57 is at the end of the adjustment range located closest to the resonator disc 53. This corresponds to the position shown in FIG. 5. The second extreme position of the frequency controller is described with broken lines, whereby the adjustment plane 56 is the closest to the resonator disc 53, and the adjustment plate 57 the farthest from it.

Figure 6:
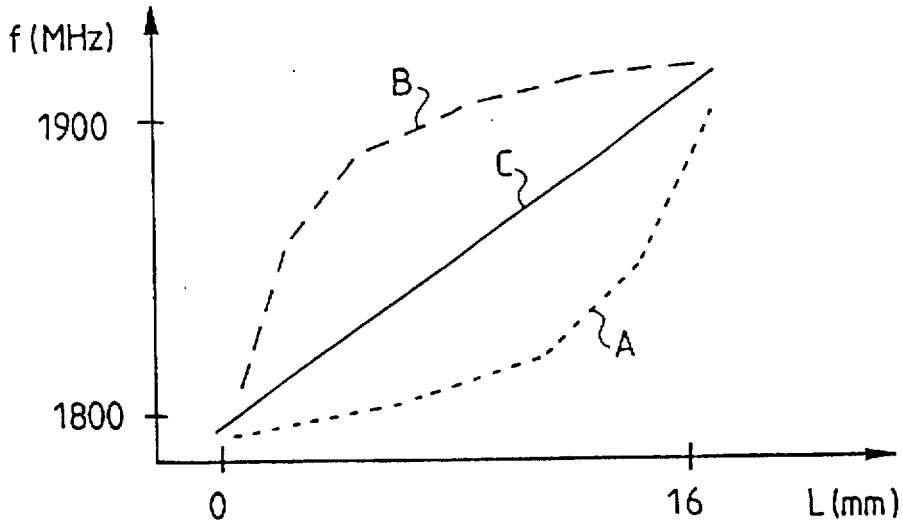
FIG. 6 shows a graph illustrating the resonance frequency of the resonator shown in FIG. 5 as a function of distance L.

As appears from the graph in FIG. 6, the metal adjustment plane 56 and the dielectric adjustment plane 57 respectively have frequency adjustment curves A and P which are substantially similar, but opposite with regard to the slopes of adjustment, so that the combined slope frequency of adjustment C of the frequency controller is substantially linear.

Figure 7:
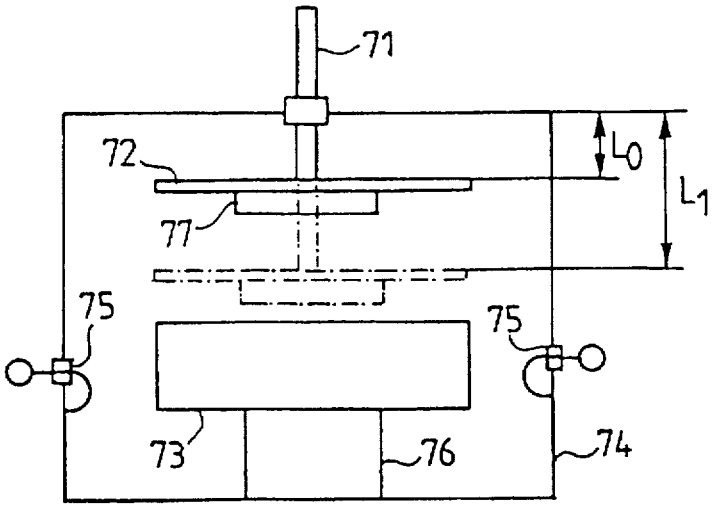
FIG. 7 shows a cross-sectional side view of another dielectric resonator of the invention.

FIG. 7 shows a dielectric resonator provided with a hybrid adjuster structure according to the invention. The resonator comprises a dielectric, preferably a cylindrical resonator disc 73 inside a casing 74 of an electrically conductive material, such as metal, said resonator disc being preferably ceramic and placed at a fixed distance from the bottom of the casing, 74 to rest on a supporting leg 76 made of appropriate dielectric or conductive material. The casing 74 is coupled to the ground potential. FIG. 7 shows by way of example the coupling to the resonator by means of inductive coupling loops 75, which provide the input and the output of the resonator.

The hybrid adjuster structure comprises a conductive adjustment plane consisting of a metal plane 72, and dielectric adjustment body 77 attached to the bottom surface of the conductive adjustment plane, said bottom surface facing the top planar surface of the resonator disc 73, so that a hybrid structure is formed, which structure is located in the casing 74 in the space above the resonator disc 73 parallel with the top planar surface of the resonator disc 73. The attachment is carried out e.g. with glue. The hybrid adjuster 72, 77 is attached to an adjustment mechanism which is composed of an adjustment screw 71 attached by threads to the bushing attached to the casing 74, so that the hybrid structure 72, 77 may be moved entirely in a vertical direction with respect to the planar surface of the resonator disc 73 for changing the distance between the hybrid structure and the planar surface.

Figure 8:
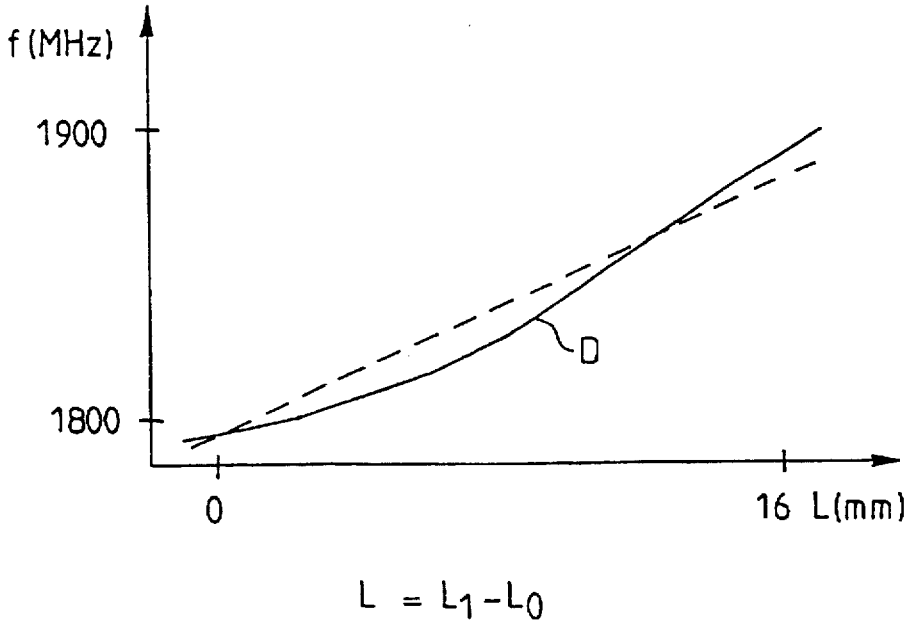
FIG. 8 shows a graph illustrating the resonance frequency of the resonator shown in FIG. 7 as a function of distance L.

The metallic adjustment plane 72 and the dielectric adjustment plane 77 have frequency adjustment curves, which are substantially similar, but opposite with regard to the slopes of adjustment, whereby the frequency adjustment curve D of the hybrid adjuster is substantially linear, as illustrated in FIG. 8.

In the graphs provided in FIGS. 2, 4, 6 and 8, the plots of frequency adjustment curves L, correspond to movement of the respective adjustment plates respectively shown in FIGS. 1, 3, 5 and 7, from $L_0L$, or, in the instance of FIG. 8, L is plotted as $L_1$–$L_0$, referring to FIG. 7A.

The figures and the explanation associated therewith are only intended to illustrate the above invention. The resonator of the invention may vary to its details within the scope of the attached claims.

I claim:

1. A dielectric resonator, comprising:

a dielectric resonator disc having two planar surfaces;

a frequency controller comprising an adjustment mechanism and an electrically conductive adjustment plate, which is substantially parallel with one of said two planar surfaces of said dielectric resonator disc, and movable by means of said adjustment mechanism in a perpendicular direction with respect to said resonator disc for adjusting the resonance frequency by changing the distance between said conductive adjustment plate and said one of said two planar surfaces of said dielectric resonator disc;

an electrically conductive casing for said dielectric resonator disc and said frequency controller;

said frequency controller further comprising a dielectric adjustment plate, which is substantially parallel with the other of said two planar surfaces of said dielectric resonator disc and connected to said adjustment mechanism, so that said dielectric adjustment plate is movable in said perpendicular direction with respect to said other of said two planar surfaces, for changing the distance between said dielectric adjustment plate and said other of said two planar surfaces of said dielectric resonator disc simultaneously and to the same extent as the distance between said conductive adjustment plate and said one of said two planar surfaces, but in an opposite direction; and said conductive adjustment plate and said dielectric adjustment plate having frequency adjustment curves, which are substantially similar, but opposite with regard to the slope of adjustment, so that a combined slope of frequency adjustment of the frequency controller resulting from combining said frequency adjustment curves is substantially linear.

2. A dielectric resonator as defined in claim 1 wherein:

said dielectric resonator disc is supported by edges thereof to said casing, said dielectric resonator disc comprises an axial center hole, said frequency adjustment mechanism comprises an adjustment screw which extends through said hole, said conductive adjustment plate is connected to said adjustment screw on one side of said resonator disc, and said dielectric adjustment plate is connected to said adjustment screw on an opposite side of said resonator disc.

* * * * *